US011391289B2

(12) United States Patent
James et al.

(10) Patent No.: US 11,391,289 B2
(45) Date of Patent: Jul. 19, 2022

(54) INTERSTAGE CAPACITY CONTROL VALVE WITH SIDE STREAM FLOW DISTRIBUTION AND FLOW REGULATION FOR MULTI-STAGE CENTRIFUGAL COMPRESSORS

(71) Applicant: TRANE INTERNATIONAL INC., Davidson, NC (US)

(72) Inventors: Rick T. James, La Crescent, MN (US); Yuanjie Wu, Onalaska, WI (US); Christopher Glen Thilges, La Crosse, WI (US); Mark W. Harrison, Onalaska, WI (US); Jon Christopher Johnson, New Albin, IA (US)

(73) Assignee: TRANE INTERNATIONAL INC., Davidson, NC (US)

( * ) Notice: Subject to any disclaimer, the term of this patent is extended or adjusted under 35 U.S.C. 154(b) by 96 days.

(21) Appl. No.: 16/863,764

(22) Filed: Apr. 30, 2020

(65) Prior Publication Data

US 2021/0340988 A1 Nov. 4, 2021

(51) Int. Cl.
*F04D 27/00* (2006.01)
*F04D 17/12* (2006.01)

(52) U.S. Cl.
CPC ..... *F04D 27/003* (2013.01); *F04D 17/122* (2013.01); *F04D 27/005* (2013.01); *F05D 2260/60* (2013.01)

(58) Field of Classification Search
CPC .... F04D 17/122; F04D 27/003; F04D 27/005; F05D 2260/60
See application file for complete search history.

(56) References Cited

U.S. PATENT DOCUMENTS 4,460,310 A 7/1984 Plunkett
4,695,224 A * 9/1987 Lown ..... F04D 29/5846 415/116

(Continued)

FOREIGN PATENT DOCUMENTS

JP S60-132099 A 7/1985
JP 3653005 5/2005

(Continued)

OTHER PUBLICATIONS

Extended European Search Report, European Patent Application No. 21170478.8, dated Sep. 22, 2021 (5 pages).

*Primary Examiner* — Courtney D Heinle
*Assistant Examiner* — Andrew J Marien
(74) *Attorney, Agent, or Firm* — Hamre, Schumann, Mueller & Larson, P.C.

(57) ABSTRACT

Centrifugal compressors can incorporate a side stream flow of intermediate pressure vapor between stages of that compressor. The side stream flow can be controlled by a side stream injection port controlled by a capacity control valve that has a curved surface facing a flow of refrigerant from the first stage to the second stage. The capacity control valve can allow or obstruct flow through the side stream injection port. The capacity control valve can extend and retract in a direction substantially perpendicular to the direction of flow from the first stage impeller to the second stage impeller. The side stream injection port and the capacity control valve can be ring-shaped. The side stream injection port and the capacity control valve can allow at least some of the side stream to be introduced on a side of the capacity control valve opposite the curved surface.

19 Claims, 12 Drawing Sheets

(56) References Cited

U.S. PATENT DOCUMENTS 6,293,103 B1 * 9/2001 Gladden ..... F02B 33/446 60/612
6,872,050 B2 3/2005 Nenstiel
7,025,557 B2 4/2006 Japikse et al.
7,326,027 B1 2/2008 Skoch et al.
7,553,122 B2 6/2009 Kirtley
7,641,439 B2 * 1/2010 Chen ..... F04D 17/122 415/116
7,905,102 B2 3/2011 Bodell et al.
8,567,207 B2 10/2013 Sommer et al.
8,632,302 B2 * 1/2014 Sorokes ..... F04D 29/444 415/161
9,353,765 B2 5/2016 Haley et al.
9,382,910 B2 7/2016 Jan et al.
9,382,911 B2 * 7/2016 Sun ..... F25B 1/10
9,388,815 B2 7/2016 Chen et al.
2007/0147987 A1 * 6/2007 Kirtley ..... F04D 27/0207 415/169.1
2012/0186605 A1 * 7/2012 Nakaniwa ..... F01D 25/002 134/24
2014/0341710 A1 11/2014 Creamer
2015/0128640 A1 5/2015 Sun et al.
2017/0198724 A1 * 7/2017 Konno ..... E21B 37/06
2018/0119569 A1 * 5/2018 Masuda ..... B08B 9/0321
2019/0024528 A1 1/2019 Baldassarre et al.
2019/0285072 A1 9/2019 Masutani et al.
2020/0109720 A1 4/2020 Turner et al.

FOREIGN PATENT DOCUMENTS

KR 100814619 3/2008
WO 2013/165841 11/2013
WO 2017/007708 1/2017

* cited by examiner

INTERSTAGE CAPACITY CONTROL VALVE WITH SIDE STREAM FLOW DISTRIBUTION AND FLOW REGULATION FOR MULTI-STAGE CENTRIFUGAL COMPRESSORS

FIELD

This disclosure is directed to an interstage capacity control valve for a centrifugal compressor, particularly one providing side stream flow regulation or distribution.

BACKGROUND

Multi-stage compressors can use single-row or multiple-row, fixed or rotatable return vanes to direct and/or control interstage flow, when operated at full and partial load conditions. These return vans can, at partial load conditions lead to low-momentum zones in return channel passages or adverse pressure gradients that alter the intended side stream injection flow rate, which can lead to compressor instability, reduced system efficiency, and result in narrower operating ranges.

SUMMARY

This disclosure is directed to an interstage capacity control valve for a centrifugal compressor, particularly one providing side stream flow regulation or distribution.

The interstage capacity control valve can simultaneously control flow between stages of a multi-stage compressor while regulating the addition of a side stream flow to that flow between stages. The interstage capacity control valve increases the velocity of the interstage flow where the side stream is added, avoiding stagnant areas of flow. This in turn can improve the stability and efficiency of the compressor at both partial and full load conditions.

The axial extension of the interstage capacity control valve further can reduce maintenance issues relating to the complexity of rotatable vane designs for capacity control in centrifugal compressors.

Further, embodiments can add the side stream flow at a comparatively low-pressure area in the interstage line, facilitating addition of the side stream and allowing more of the side stream to be successfully introduced. This can avoid cycling and compression of bypass gases.

In an embodiment, a centrifugal compressor includes a first stage impeller and a second stage impeller. The centrifugal compressor includes a side stream injection port located between the first stage impeller and the second stage impeller, the side stream injection port configured to receive a side stream of a fluid. The centrifugal compressor includes a capacity control valve. The capacity control valve is configured to extend and retract through the side stream injection port. The capacity control valve has a curved surface facing a direction of flow from the first stage impeller to the second stage impeller. The capacity control valve is configured to be extended through the side stream injection port between an open position where the side stream of the fluid can flow through the side stream injection port and a closed position where the capacity control valve obstructs flow of the side stream of the fluid through the side stream injection port.

In an embodiment, the capacity control valve has a ring shape.

In an embodiment, the centrifugal compressor includes a plurality of the side stream injection ports and a plurality of the capacity control valves.

In an embodiment, when in the open position, a tip of the capacity control valve at an end of the curved surface is within the side stream injection port.

In an embodiment, the capacity control valve extends and retracts in a direction substantially perpendicular to the direction of flow from the first stage impeller to the second stage impeller.

In an embodiment, the centrifugal compressor further includes one or more deswirl vanes between the first stage impeller and the second stage impeller. In an embodiment, the capacity control valve includes one or more notches, the one or more notches each configured to accommodate at least a portion of one of the one or more deswirl vanes. In an embodiment, the one or more deswirl vanes each include one or more notches, the one or more notches each configured to accommodate at least a portion of the capacity control valve.

In an embodiment, the capacity control valve has a linear meridional profile on a side opposite the curved surface, the linear meridional profile contacting an edge of the side stream injection port.

In an embodiment, a side of the capacity control valve opposite the curved surface is configured such that when the capacity control valve is between the open position and the closed position, the fluid can flow past the capacity control valve on the side of the capacity control valve opposite the curved surface. In an embodiment, the side of the capacity control valve opposite the curved surface includes a second curved surface. In an embodiment, the side of the capacity control valve opposite the curved surface includes one or more channels configured to allow flow of the side stream of the fluid.

In an embodiment, a heating, ventilation, air conditioning, and refrigeration (HVACR) circuit includes a centrifugal compressor, a condenser, an expander, and an evaporator. The centrifugal compressor includes a first stage impeller and a second stage impeller. The centrifugal compressor also includes side stream injection port located between the first stage impeller and the second stage impeller. The side stream injection port is configured to receive a side stream of a fluid. The centrifugal compressor further includes a capacity control valve. The capacity control valve is configured to extend and retract through the side stream injection port. The capacity control valve has a curved surface facing a direction of flow from the first stage impeller to the second stage impeller. The capacity control valve is configured to be extended through the side stream injection port between an open position where the side stream of the fluid can flow through the side stream injection port and a closed position where the capacity control valve obstructs flow of the side stream of the fluid through the side stream injection port.

In an embodiment, the side stream of the fluid is from the condenser to the side stream injection port.

In an embodiment, the HVACR circuit further includes an economizer and wherein the side stream of the fluid is from the economizer to the side stream injection port.

In an embodiment, the HVACR circuit further includes an intercooler and wherein the side stream of the fluid is from the intercooler to the side stream injection port.

In an embodiment, the capacity control valve has a ring shape.

In an embodiment, the capacity control valve has a linear meridional profile on a side opposite the curved surface, the linear meridional contacting an edge of the side stream injection port. In an embodiment, a side of the capacity control valve opposite the curved surface is configured such that when the capacity control valve is between the open position and the closed position, the fluid can flow past the capacity control valve on the side of the capacity control valve opposite the curved surface.

DRAWINGS

DETAILED DESCRIPTION

This disclosure is directed to an interstage capacity control valve for a centrifugal compressor, particularly one providing side stream flow regulation or distribution.

Figure 1A:
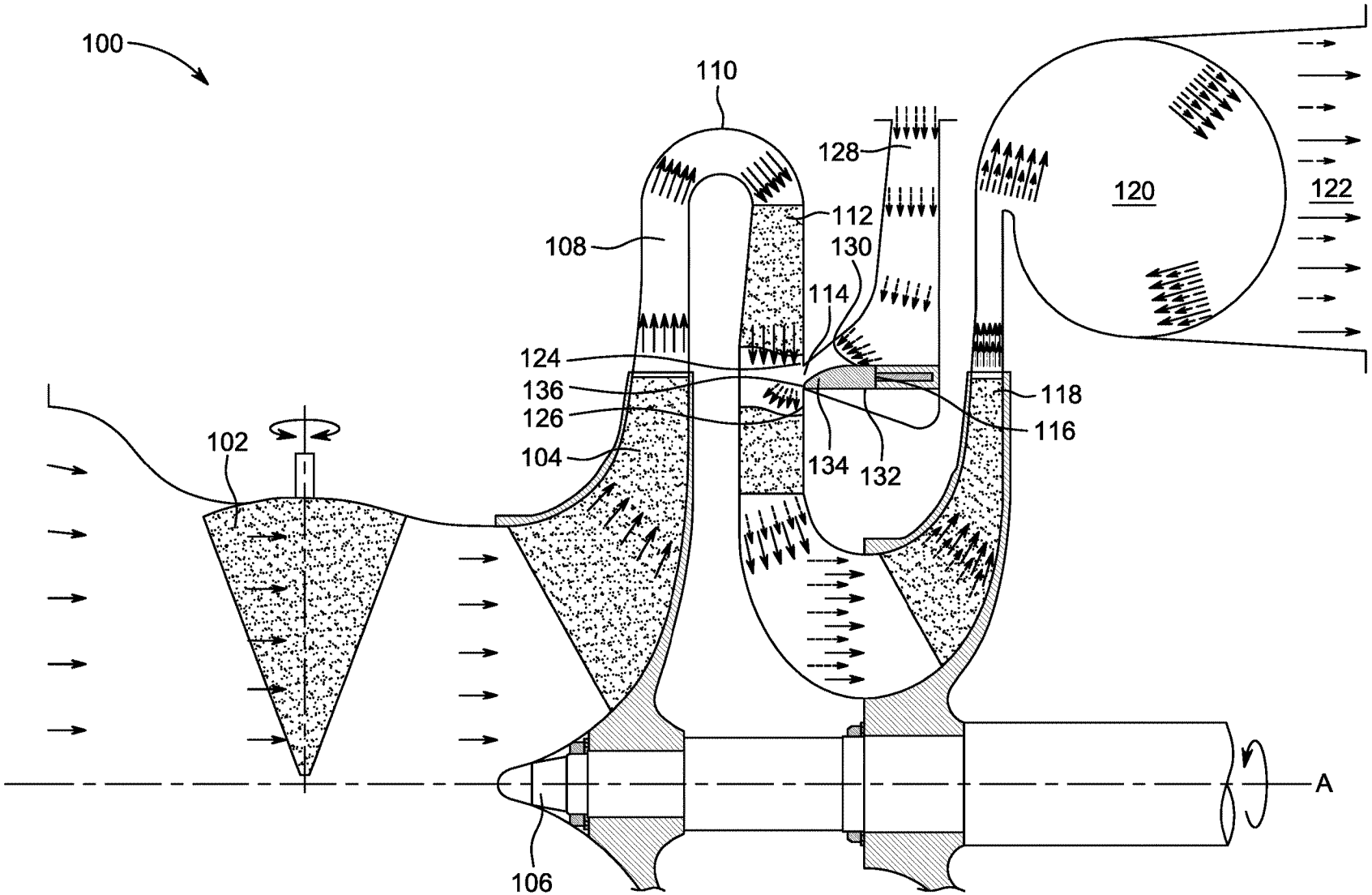
FIG. 1A shows a sectional view of a compressor according to an embodiment when a capacity control valve is in a fully open position.

FIG. 1A shows a sectional view of a compressor 100 according to an embodiment when a capacity control valve is in a fully open position. Compressor 100 can have a cylindrical structure such that the sectional view shown in FIGS. 1A-1D be repeated or continuous through 360° of rotation about axis A of the compressor 100.

Compressor 100 is a multi-stage centrifugal compressor according to an embodiment. Compressor 100 includes an inlet guide vane 102 where a core flow of fluid to be compressed is received. Compressor 100 includes a first stage impeller 104 driven by rotation of shaft 106, a diffuser 108 downstream of the first stage impeller 104, and a return bend 110 downstream of the diffuser 108. Compressor 100 further includes one or more deswirl vanes 112 downstream of the return bend 110. Compressor 100 includes a side stream injection port 114 and a capacity control valve 116. Compressor 100 includes a second stage impeller 118 downstream of the deswirl vanes 112 and the side stream injection port 114, with a volute scroll 120 and a discharge conic 122 downstream of the second stage impeller 118.

While compressor 100 is shown in FIGS. 1A-1D as a two-stage compressor, compressors according to embodiments can include any number of stages, with the side stream injection port 114 and the capacity control valve 116 are provided in an interstage flow path between any two stages of the compressor. For example, compressor 100 can be a three-stage compressor, with the side stream injection port 114 and capacity control valve 116 disposed between the exhaust of the second stage and the intake of the third stage, or the like.

Flow of working fluid into compressor 100 may be controlled using one or more inlet guide vanes 102. The one or more inlet guide vanes 102 can be configured to obstruct or permit flow of working fluid into the compressor 100. In an embodiment, each of the inlet guide vanes 102 can be a rotating vane, for example, each rotating vane forming a section of a circle such that when all rotating vanes are in a closed position, the inlet guide vanes 102 obstruct an inlet of the compressor 100. The one or more inlet guide vanes 102 can be movable between a fully open position and the closed position. In the fully open position the effect of the inlet guide vanes 102 on flow into compressor 100 can be minimized, for example by positioning the inlet guide vanes 102 such that the plane of each vane is substantially parallel to the direction of flow of working fluid into the inlet of compressor 100. In an embodiment, each or all of the one or more inlet guide vanes 102 can be varied continuously from the fully open position to the closed position, through one or more partially open positions.

Compressor 100 includes a first stage impeller 104. The first stage impeller 104 includes a plurality of blades. The first stage impeller 104 is configured to draw in the working fluid that passes the one or more inlet guide vanes 102 when rotated, and to expel the working fluid towards diffuser 108. The first stage impeller 104 is joined to shaft 106. Shaft 106 is rotated by, for example, a prime mover such as a motor.

Diffuser 108 receives the fluid discharged from first stage impellers 104 and directs the flow of the fluid towards return bend 110. Return bend 110 changes the direction of the flow of the fluid such that it travels through the deswirl vanes 112 towards the second stage impeller 118.

One or more deswirl vanes 112 are vanes extending from the return bend 110 towards the second stage impeller 118. The deswirl vanes 112 are shaped to straighten the flow of the fluid as the flow passes towards the second stage impeller 118. The deswirl vanes 112 can include notches configured to receive at least a portion of the capacity control valve 116.

Side stream injection port 114 is a port configured to allow a side stream to be introduced into the interstage flow of fluid through compressor 100. The side stream injection port 114 includes a leading end 124 and a trailing end 126, with the leading end 124 towards the return bend 110 and the trailing end 126 towards the second stage impeller 118. Side stream injection port 114 fluidly connects a side stream flow channel 128 with the interstage flow. The side stream flow channel 128 can receive a side stream of fluid from within a fluid circuit including the compressor 100. The source of the side stream of fluid received by side stream flow channel can be from one or more of a condenser, an economizer, an intercooler, a heat exchanger, or any other suitable source of fluid that is at an intermediate pressure, between the suction pressure and the discharge pressure of the compressor 100. The side stream injection port 114 can be a ring shape surrounding an intake of the second stage impeller 118. The side stream injection port 114 can be provided between the return bend 110 and the second stage impeller 118.

Capacity control valve 116 is a valve configured regulate the flow through the side stream injection port 114. Capacity control valve 116 is configured to be extended axially through the side stream injection port 114 such that it extends substantially perpendicular to a direction of flow of the interstage flow from deswirl vane 110 towards the second stage impeller 118. Capacity control valve 116 is configured to be able to prohibit flow through side stream injection port 114 in a closed position, for example by including a portion having a thickness corresponding to the width of the side stream injection port 114 from leading end 124 to trailing end 126. In an embodiment, capacity control valve 116 is controlled in conjunction with inlet guide vanes 102. In an embodiment, capacity control valve 116 is controlled independently of inlet guide vanes 102.

Capacity control valve 116 includes a leading side 130 facing towards the return bend 110 and a trailing side 132 facing towards an inlet into second stage impeller 118. Leading side 130 includes curved surface 134 extending towards a tip 136 of the capacity control valve 116. The curved surface 134 can reduce the cross-sectional thickness of the capacity control valve 116 from a thickness corresponding to the width of the side stream injection port 114 at the base of the curved surface 134 to a smaller thickness at the tip 136. The change in the cross-sectional thickness of capacity control valve 116 over the length of curved surface 134 towards tip 136 is configured to vary the amount of flow through the side stream injection port based on the extension of the capacity control valve 116. In the embodiment shown in FIGS. 1A-1D, trailing side 132 can be, for example, a linear meridional profile in the longitudinal direction of the capacity control valve 116 configured to always be in contact with trailing end 126 of the side stream injection port 114, such that all flow of the side stream into the interstage flow is over the leading side 130.

Where side stream injection port 114 has a ring shape, the capacity control valve 116 can have a corresponding ring shape. In an embodiment, the capacity control valve is a single ring. In an embodiment, the capacity control valve includes a plurality of ring segments. In an embodiment, the capacity control valve 116 includes one or more notches configured to avoid contact between the capacity control valve 116 and one or more deswirl vanes 112 as the capacity control valve 116 is extended. In an embodiment, the capacity control valve can be moved from a fully open position where the tip 136 is located within the side stream injection port 116 or the side stream channel 128, and a fully closed position, where the capacity control valve 116 obstructs the side stream injection port 114 from leading end 124 to trailing end 126.

In the fully open position of the capacity control valve 116, the tip 136 of the capacity control valve 116 does not extend through the side stream injection port 114. Accordingly, the interstage flow through the deswirl vane 112 is not obstructed, and obstruction of the side stream injection port 114 by the capacity control valve is at a minimum. The side stream fluid passes over the curved surface 134 to join the interstage flow between return bend 110 and second stage impeller 118. The fully open position can be used when the compressor 100 is operating at or near a full-load capacity.

Second stage impeller 118 is used to achieve the second stage of compression. Second stage impeller 118 draws in the combined interstage and side stream flows and expels the fluid towards volute scroll 120. Second stage impeller 118 can be rotated by shaft 106, which is also used to rotate first stage impeller 104. Fluid at the volute scroll 120 can then be discharged from compressor 100 at discharge conic 122.

In an embodiment, the side stream provided through side stream injection port 114 can be received from an economizer, such as the economizer 314 shown in FIG. 3B and described below. The economizer can be a flash-tank economizer, where flash or bypass gas rises and can be directed to the side stream flow channel 128. The gas from the economizer being directed to the side stream flow channel 128 can reduce or eliminate the presence of gas in the liquid being passed to an evaporator of the HVACR system including compressor 100. This can in turn improve the absorption of energy at the evaporator without further subcooling by providing more saturated liquid working fluid. In the full load cycle corresponding to the fully open position of capacity control valve 116, the pressure at the side stream injection port 114 can allow the entrained vapor to be substantially removed from the working fluid in the economizer.

Figure 1B:
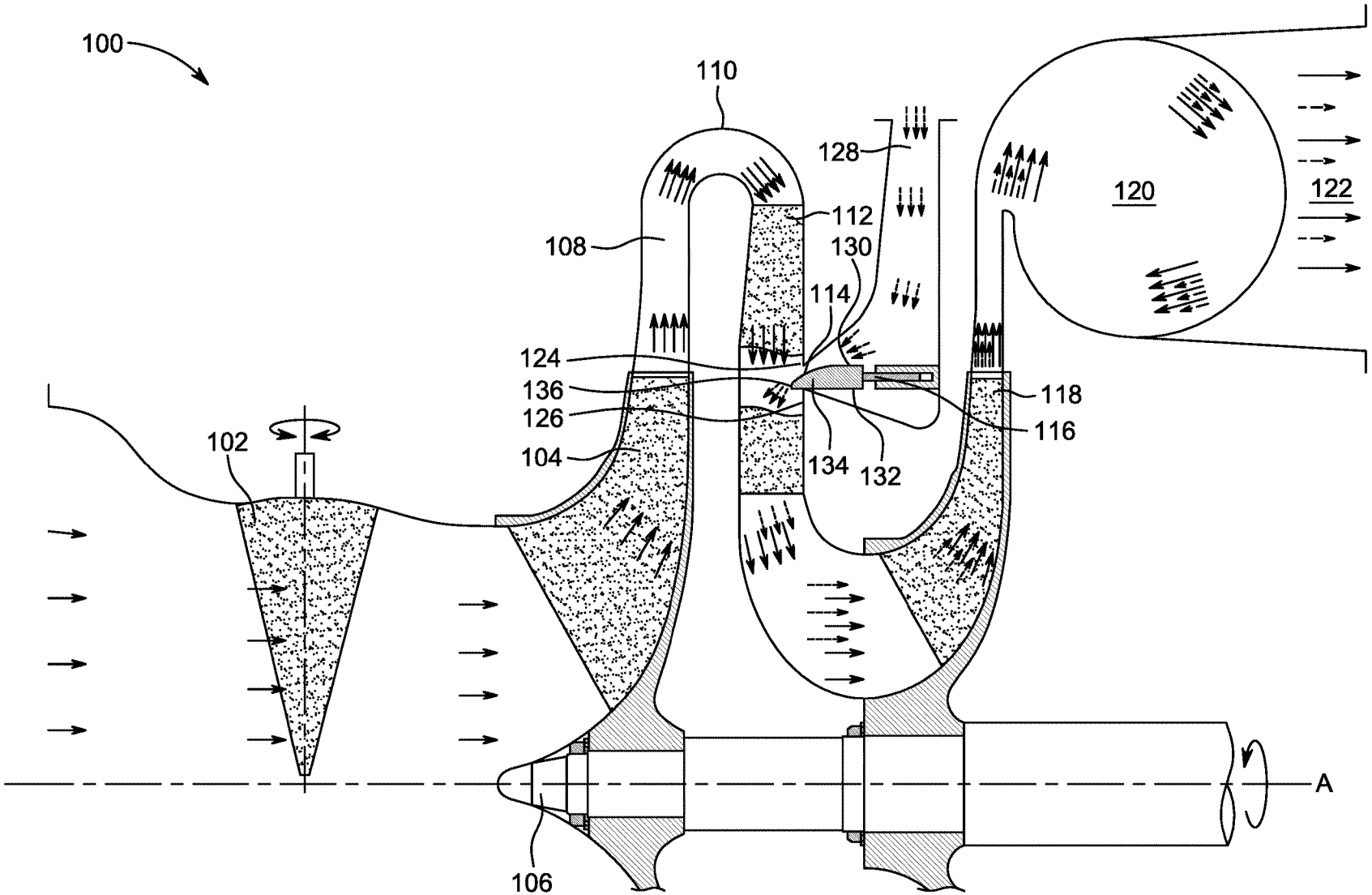
FIG. 1B shows a sectional view of the compressor shown in FIG. 1A when the capacity control valve is in a high flow position.

FIG. 1B shows a sectional view of the compressor shown in FIG. 1A when the capacity control valve 116 is in a high flow position. The high flow position shown in FIG. 1B can be used in a partial load condition where the load is relatively close to full load for the compressor 100. In the high flow position shown in FIG. 1B, the capacity control valve 116 is extended axially such that it partially extends through side stream injection port 114. The leading side 130 of the capacity control valve 116 partially deflects the interstage flow in compressor 100 due to the projection of the capacity control valve reducing the size of the passage for interstage flow. The capacity control valve 116 restricts flow through the side stream injection port to a greater extent than when in the fully-open position shown in FIG. 1A and described above, with curved surface 134 reducing the orifice size by being closer to the leading end 124 of the side stream injection port 114. The trailing side 132 of the capacity control valve 116 continues to be in contact with the trailing end 126 of the side stream injection port 114, and all flow through side stream injection port 114 passes between the leading end 124 of side stream injection port 114 and the leading side 130 of capacity control valve 116. Optionally, inlet guide vane 102 can be rotated to partially obstruct flow to the first stage impeller 104 of compressor 100.

Figure 1C:
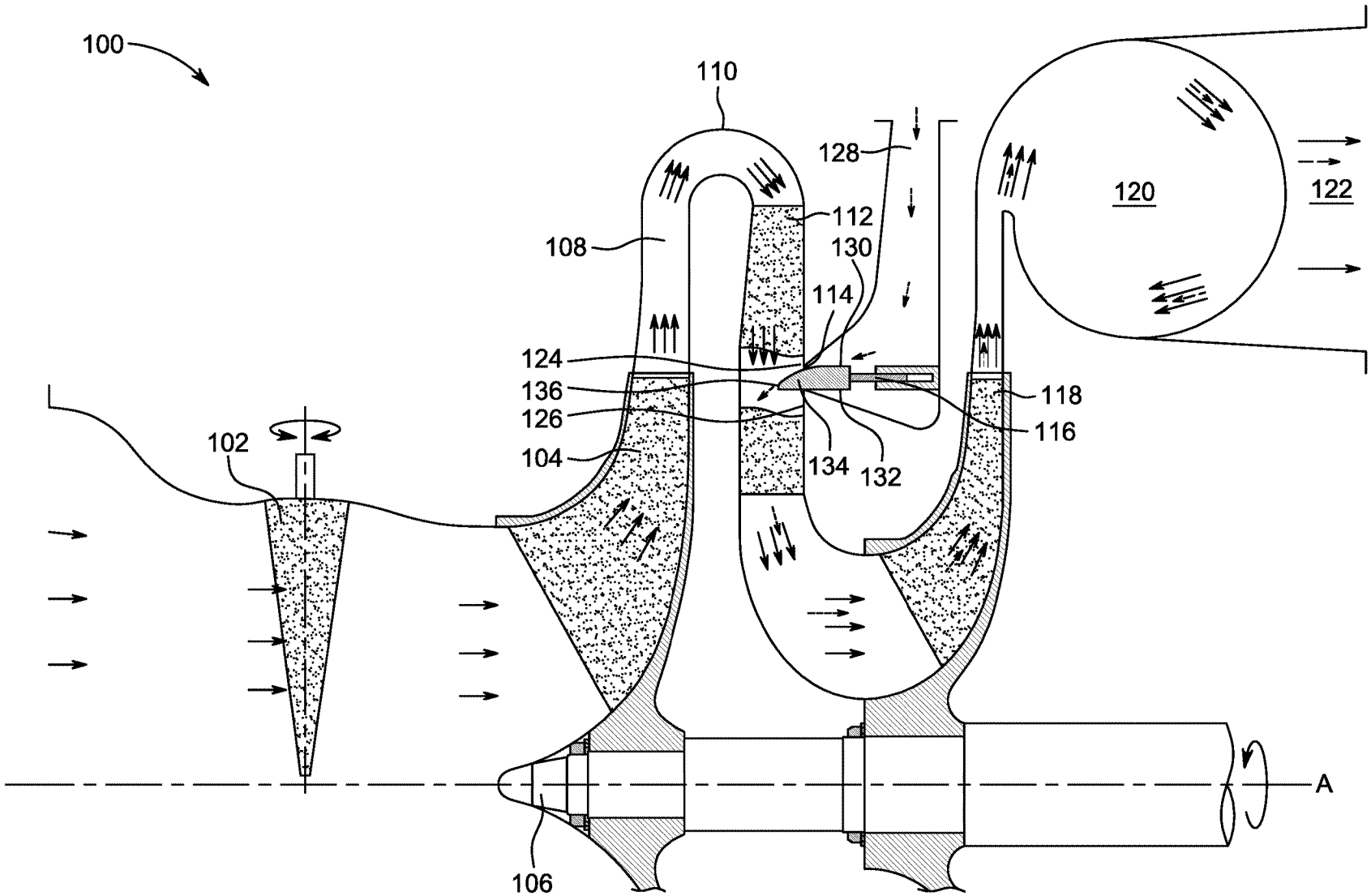
FIG. 1C shows a sectional view of the compressor shown in FIG. 1A when the capacity control valve is in a low flow position.

FIG. 1C shows a sectional view of the compressor shown in FIG. 1A when the capacity control valve is in a low flow position. The low flow position shown in FIG. 1C can be used in a partial load condition where the load is below the full load for the compressor 100, and less than the load where the capacity control valve is in a high flow position such as in FIG. 1B. In the low flow position shown in FIG. 1C, the capacity control valve 116 is extended axially such that it extends through side stream injection port 114, extending further than the high flow position shown in FIG. 1B. The leading side 130 of the capacity control valve 116 deflects the interstage flow in compressor 100 due to the greater projection of the capacity control valve 116, further reducing the size of the passage for interstage flow. The capacity control valve 116 restricts flow through the side stream injection port to a greater extent than when in the high flow position shown in FIG. 1B and described above, with curved surface 134 further reducing the orifice size by being even closer to the leading end 124 of the side stream injection port 114. The trailing side 132 of the capacity control valve 116 continues to be in contact with the trailing end 126 of the side stream injection port 114, and all flow through side stream injection port 114 passes between the leading end 124 of side stream injection port 114 and the leading side 130 of capacity control valve 116. Optionally, inlet guide vane 102 can be rotated to further obstruct flow to the first stage impeller 104 of compressor 100 compared to its position in the high flow position shown in FIG. 1B.

Figure 1D:
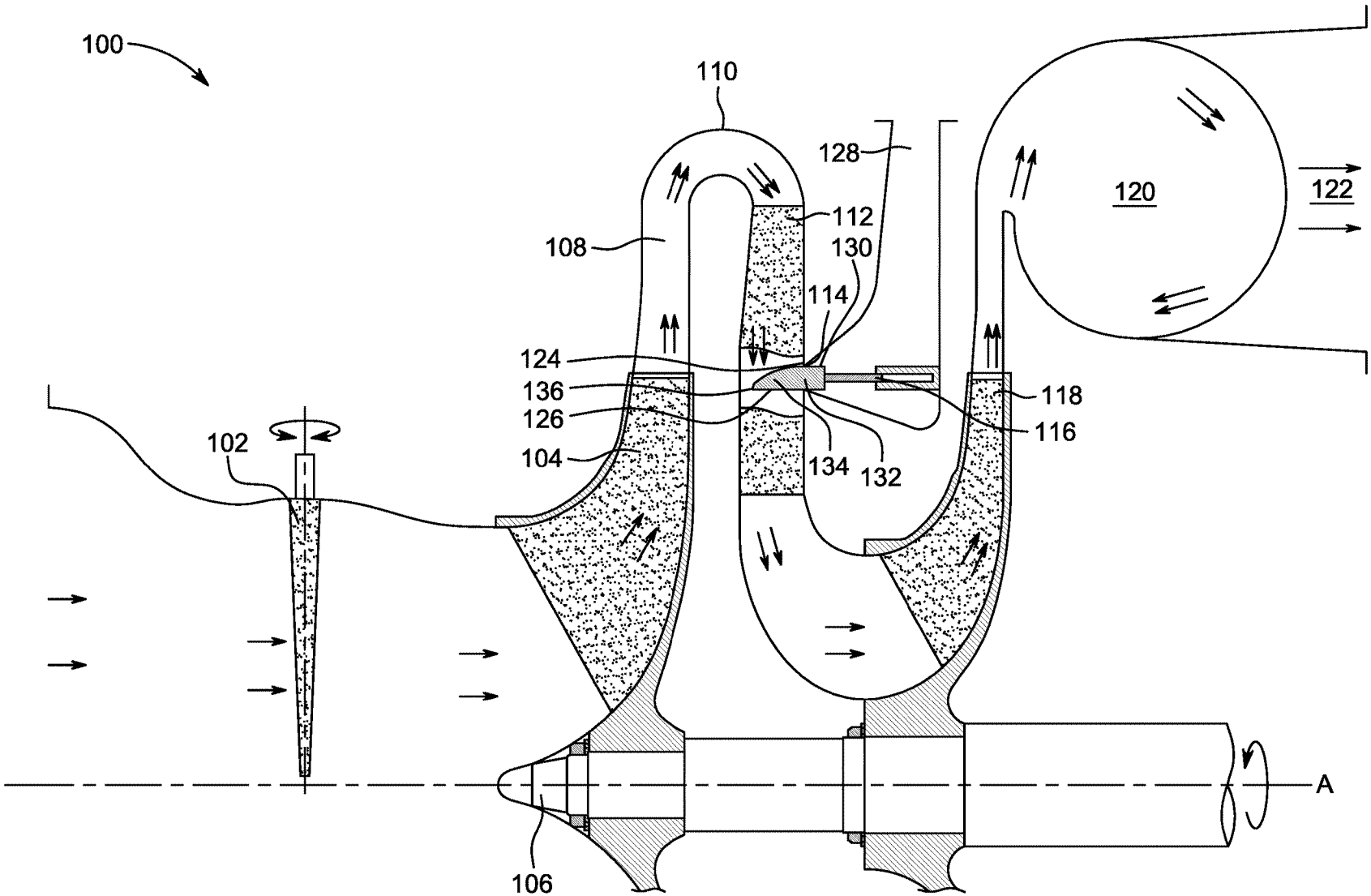
FIG. 1D shows a sectional view of the compressor shown in FIG. 1A when the capacity control valve is in a closed position.

FIG. 1D shows a sectional view of the compressor shown in FIG. 1A when the capacity control valve is in a closed position. The closed position shown in FIG. 1D can be used when the compressor 100 is in a partial-load condition at or near a minimum load for the compressor. In the closed position, capacity control valve 116 partially or completely obstructs side stream injection port 114, from leading end 124 to trailing end 126. It is appreciated that due to manufacturing tolerances, wear, etc. that there may be some leakage even when the capacity control valve 116 is configured to completely obstruct the side stream and is in the closed position. In an embodiment, capacity control valve 116 is sized such that it does not contact side stream injection port 114 and allows some flow to continue through side stream injection port 114 even in the fully extended closed position. The extension of the capacity control valve 116 into the interstage flow through compressor 100 is at a maximum, reducing the size of the orifice through which the interstage flow passes from return bend 110 towards second stage impeller 118. Accordingly, this position imparts the greatest additional velocity to the interstage flow, while prohibiting the side stream flow from joining the interstage flow. Optionally, inlet guide vane 102 can be rotated to further obstruct flow to the first stage impeller 104 of compressor 100, for example by pacing the inlet guide vane 102 in a minimum-flow position.

Figure 2A:
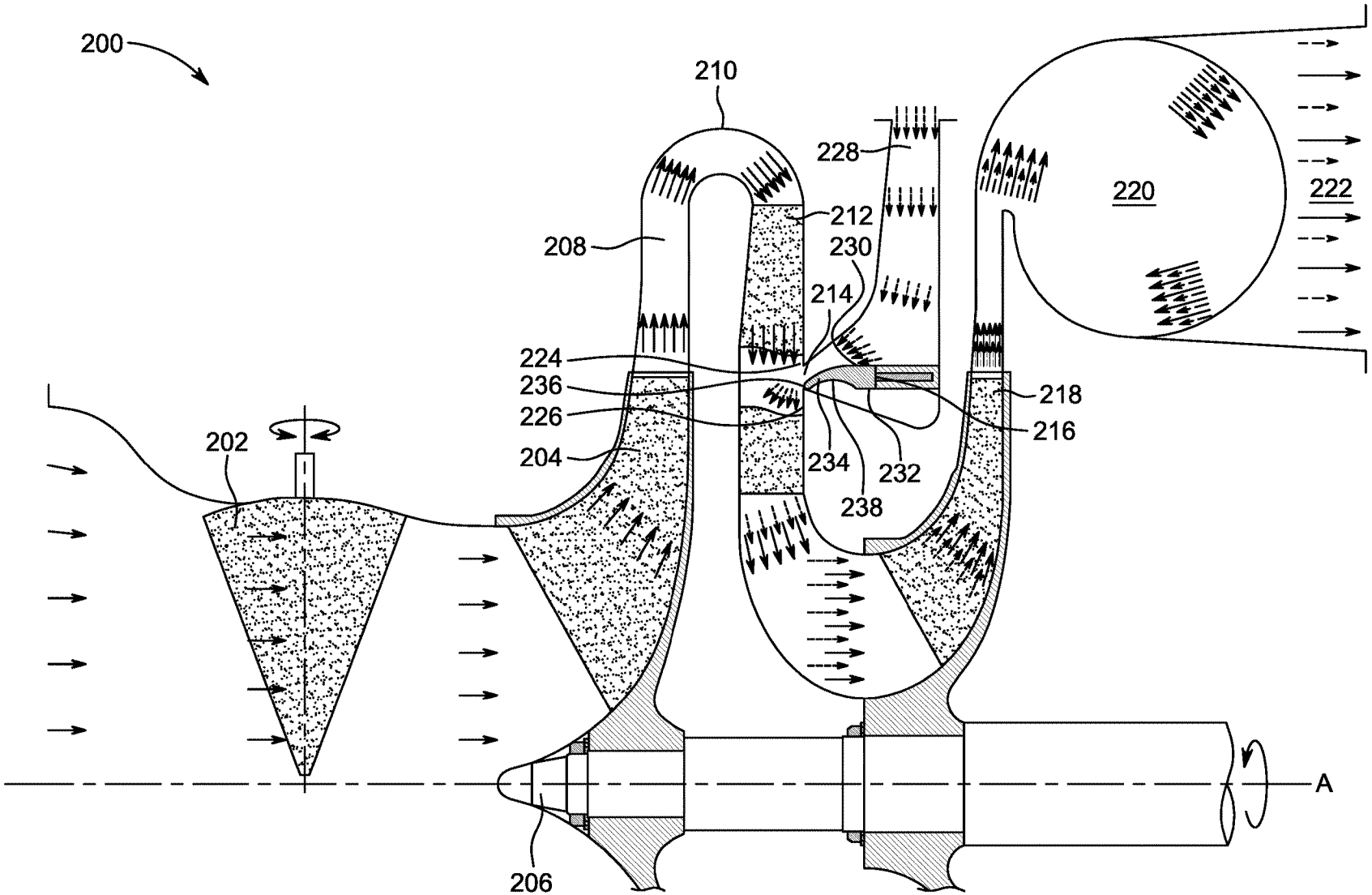
FIG. 2A shows a sectional view of a compressor according to an embodiment when a capacity control valve is in a fully open position.

FIG. 2A shows a sectional view of a compressor 200 according to an embodiment when a capacity control valve is in a fully open position. Compressor 200 can have a cylindrical structure such that the sectional view shown in FIGS. 2A-2D be repeated or continuous through 360° of rotation about axis A of the compressor 200.

Compressor 200 is a multi-stage centrifugal compressor. Compressor 200 includes an inlet guide vane 202 where a core flow of fluid to be compressed is received. Compressor 200 includes a first stage impeller 204 driven by rotation of shaft 206, a diffuser 208 downstream of the first stage impeller 204, and a return bend 210 downstream of the diffuser 208. Compressor 200 further includes one or more deswirl vanes 212 downstream of the return bend 210. Compressor 200 includes a side stream injection port 214 and a capacity control valve 216. Compressor 200 includes a second stage impeller 218 downstream of the deswirl vanes 212 and the side stream injection port 214, with a volute scroll 220 and a discharge conic 222 downstream of the second stage impeller 218.

While compressor 200 is shown in FIGS. 2A-2D as a two-stage compressor, compressors according to embodiments can include any number of stages, with the side stream injection port 214 and the capacity control valve 216 are provided in an interstage flow path between any two stages of the compressor. For example, compressor 200 can be a three-stage compressor, with the side stream injection port 214 and capacity control valve 216 disposed between the exhaust of the second stage and the intake of the third stage, or the like.

Compressor 200 can include one or more inlet guide vane 202 to control flow of working fluid into the compressor 200. The inlet guide vanes 202 can be substantially similar to the inlet guide vanes 102 described above and shown in FIGS. 1A-1D. The one or more inlet guide vanes 202 can be configured to obstruct or permit flow of working fluid into the compressor 200. In an embodiment, each of the inlet guide vanes 202 can be a rotating vane, for example, each rotating vane forming a section of a circle such that when all rotating vanes are in a closed position, the inlet guide vanes 202 obstruct an inlet of the compressor 200. The one or more inlet guide vanes 202 can be movable between a fully open position and the closed position. In the fully open position the effect of the inlet guide vanes 202 on flow into compressor 200 can be minimized, for example by positioning the inlet guide vanes 202 such that the plane of each vane is substantially parallel to the direction of flow of working fluid into the inlet of compressor 200. In an embodiment, each or all of the one or more inlet guide vanes 202 can be varied continuously from the fully open position to the closed position.

Compressor 200 includes a first stage impeller 204. The first stage impeller 204 is driven by shaft 206. Shaft 206 is rotated by, for example, a prime mover such as a motor. The first stage impellers 204 are configured to draw in the working fluid that passes the one or more inlet guide vanes 202 when rotated, and to expel the working fluid towards diffuser 208.

Diffuser 208 receives the fluid discharged from first stage impellers 204 and directs the flow of the fluid towards return bend 210. Return bend 210 changes the direction of the flow of the fluid such that it travels through the deswirl vanes 212 towards the second stage impeller 218.

One or more deswirl vanes 212 are vanes extending from the return bend 210 towards the second stage impeller 218. The deswirl vanes 212 are shaped to straighten the flow of the fluid as the flow passes towards the second stage impeller 218. The deswirl vanes 212 can include notches configured to receive at least a portion of the capacity control valve 216.

Side stream injection port 214 is a port configured to allow a side stream to be introduced into the interstage flow of fluid through compressor 200. The side stream injection port 214 includes a leading end 224 and a trailing end 226, with the leading end 224 towards the return bend 210 and the trailing end 226 towards the second stage impeller 218. Side stream injection port 214 fluidly connects a side stream flow channel 228 with the interstage flow. The side stream flow channel 228 can receive a side stream of fluid from within a fluid circuit including the compressor 200. The source of the side stream of fluid received by side stream flow channel 228 can be from one or more of a condenser, an economizer, an intercooler, a heat exchanger, or any other suitable source of fluid that is at an intermediate pressure, between the suction pressure and the discharge pressure of the compressor 200. The side stream injection port 214 can be a ring shape surrounding an intake of the second stage impeller 218. The side stream injection port 214 can be provided between the return bend 210 and the second stage impeller 218.

Capacity control valve 216 is a valve that configured regulate the flow through the side stream injection port 214. Capacity control valve 216 is configured to be extended axially through the side stream injection port 214 such that it extends substantially perpendicular to a direction of flow of the interstage flow from deswirl vane 212 towards the second stage impeller 218. Capacity control valve 216 is configured to be able to prohibit flow through side stream injection port 214 in a closed position, for example by including a portion having a thickness corresponding to the width of the side stream injection port 214 from leading end 224 to trailing end 226. In an embodiment, capacity control valve 216 is controlled in conjunction with inlet guide vanes 202. In an embodiment, capacity control valve 216 is controlled independently of inlet guide vanes 202.

Capacity control valve 216 includes a leading side 230 facing towards the return bend 210 and a trailing side 232 facing towards an inlet into second stage impeller 218. Leading side 230 includes curved surface 234 extending towards a tip 236 of the capacity control valve 116. The curved surface 234 can cause the distance between capacity control valve 216 and leading end 224 of side stream injection port 214 to be varied as capacity control valve 216 is axially extended or retracted.

Trailing side 232 includes one or more passages 238 configured to allow the side stream flow from side stream flow channel 228 to pass through the side stream injection port 214 and be introduced into the interstage flow on the trailing side 232 of the capacity control valve 216. In an embodiment, passage 238 includes one or more channels having openings on the trailing side 232 of the capacity control valve 216. In an embodiment, passage 238 is a cutout or scalloping formed in the trailing side 232, such that in some positions of capacity control valve 216, a gap exists between the trailing side 232 and the trailing end 224 of the side stream injection port 214.

In the fully open position of the capacity control valve 216, side stream flow passes from the side stream flow channel 228 through side stream injection port 214, between the leading end 224 of the side stream injection port 214 and the leading side 230 of the capacity control valve 216. Tip 236 of the capacity control valve 216 is located within the side stream injection port 214 or retracted into the side stream flow channel 228, and capacity control valve 216 does not substantially affect the interstage flow passing from return bend 210 to second stage impeller 218. Optionally, in the fully open position shown in FIG. 2A, inlet guide vane 202 can be in an open position where it provides little to no resistance to flow into the first stage impeller 204. The fully open position shown in FIG. 2A can be used, for example, when compressor 200 is being operated at or near full load capacity. In the embodiment shown in FIG. 2, when in the fully open position shown in FIG. 2A, some or all of the side stream flow passing through side stream injection port 214 can pass over the leading side 230 of capacity control valve 216.

Second stage impeller 218 is used to achieve the second stage of compression. Second stage impeller 218 draws in the combined interstage and side stream flows and expels the fluid towards volute scroll 220. Second stage impeller 218 can be rotated by shaft 206, which is also used to rotate first stage impeller 204. Fluid at the volute scroll 220 can then be discharged from compressor 200 at discharge conic 222.

In an embodiment, the side stream provided through side stream injection port 214 can be received from an economizer, such as the economizer 314 shown in FIG. 3B and described below. The economizer can be a flash-tank economizer, where flash or bypass gas rises and can be directed to the side stream flow channel 228. The gas from the economizer being directed to the side stream flow channel 228 can reduce or eliminate the presence of gas in the liquid being passed to an evaporator of the HVACR system including compressor 200. This can in turn improve the absorption of energy at the evaporator without further subcooling by providing more saturated liquid working fluid. In the full load cycle corresponding to the fully open position of capacity control valve 216, the pressure at the side stream injection port 214 can allow the entrained vapor to be substantially removed from the working fluid in the economizer.

Figure 2B:
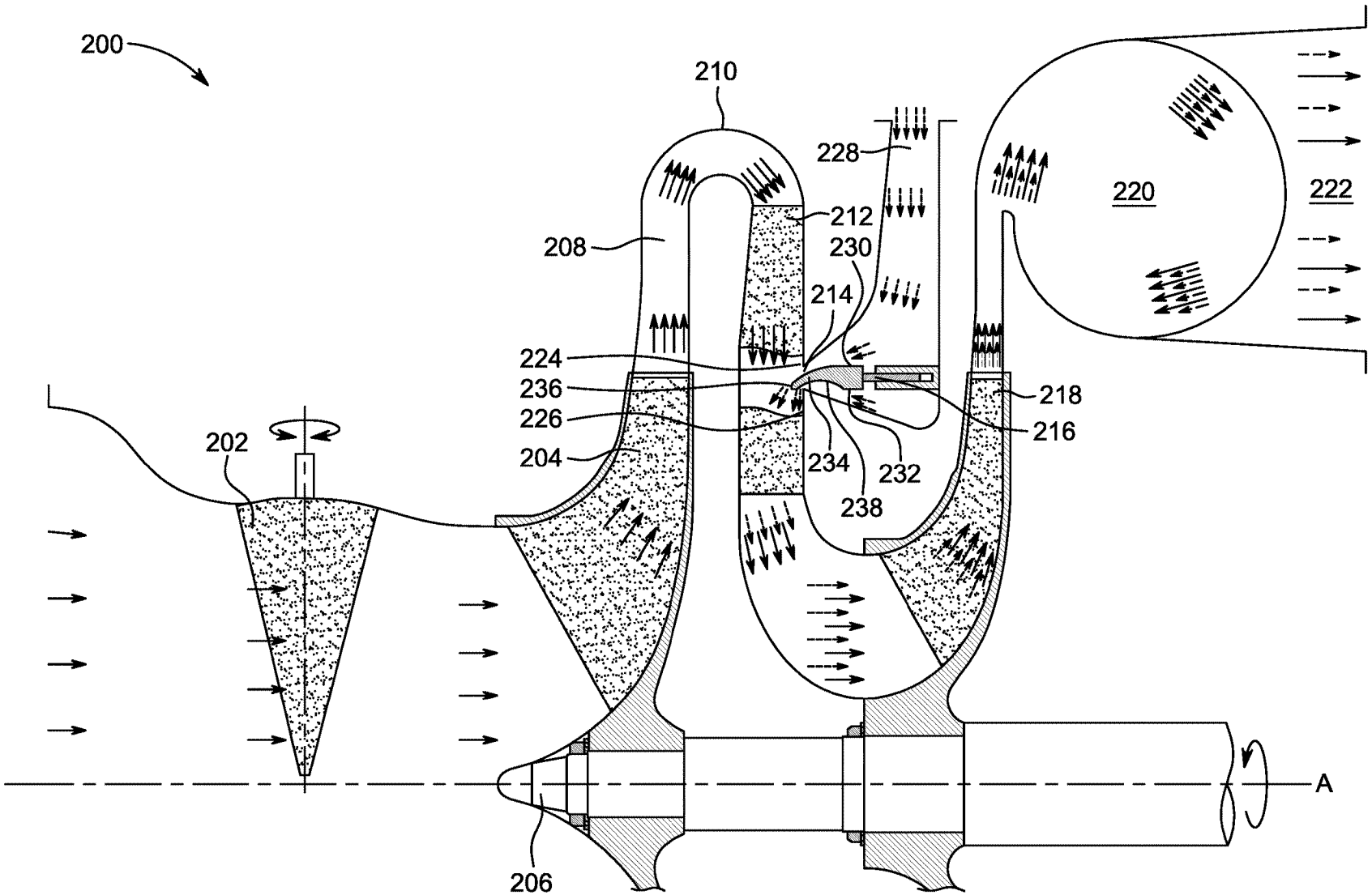
FIG. 2B shows a sectional view of the compressor shown in FIG. 2A when the capacity control valve is in a high flow position.

FIG. 2B shows a sectional view of the compressor shown in FIG. 2A when the capacity control valve 216 is in a high flow position. The high flow position shown in FIG. 2B can be used in a partial load condition where the load is relatively close to full load for the compressor 200. In the high flow position shown in FIG. 2B, capacity control valve 216 is extended such that tip 236 projects into the path for interstage flow from return bend 210 to the second impeller 218, partially obstructing the path for the interstage flow. In the high flow position of the embodiment shown in FIG. 2B, a first gap exists between the leading end 224 of the side stream injection port and the leading side 230 of the capacity control valve 216, and a second gap exists at passage 238 between the trailing side 232 of the capacity control valve 216 and the trailing end 226 of the side stream injection port 214. Each of the first and second gaps allow some of the side stream flow to join the interstage flow. The portion passing through the second gap experiences less of the pressure exerted by the interstage flow due to its introduction on the trailing side 232 of the capacity control valve 216. Optionally, in the high flow position shown in FIG. 2B, inlet guide vane 202 can be in a high flow position where the inlet guide vane 202 provides increased resistance to flow into the first stage impeller 204 compared to the fully open position shown in FIG. 2A, but less resistance to flow than the low flow or closed positions shown in FIGS. 2C and 2D, respectively. In the high-flow position shown in FIG. 2B, flow through side stream injection port 214 can include both flow over the leading side 230 and past the trailing side 232 of the capacity control valve.

Figure 2C:
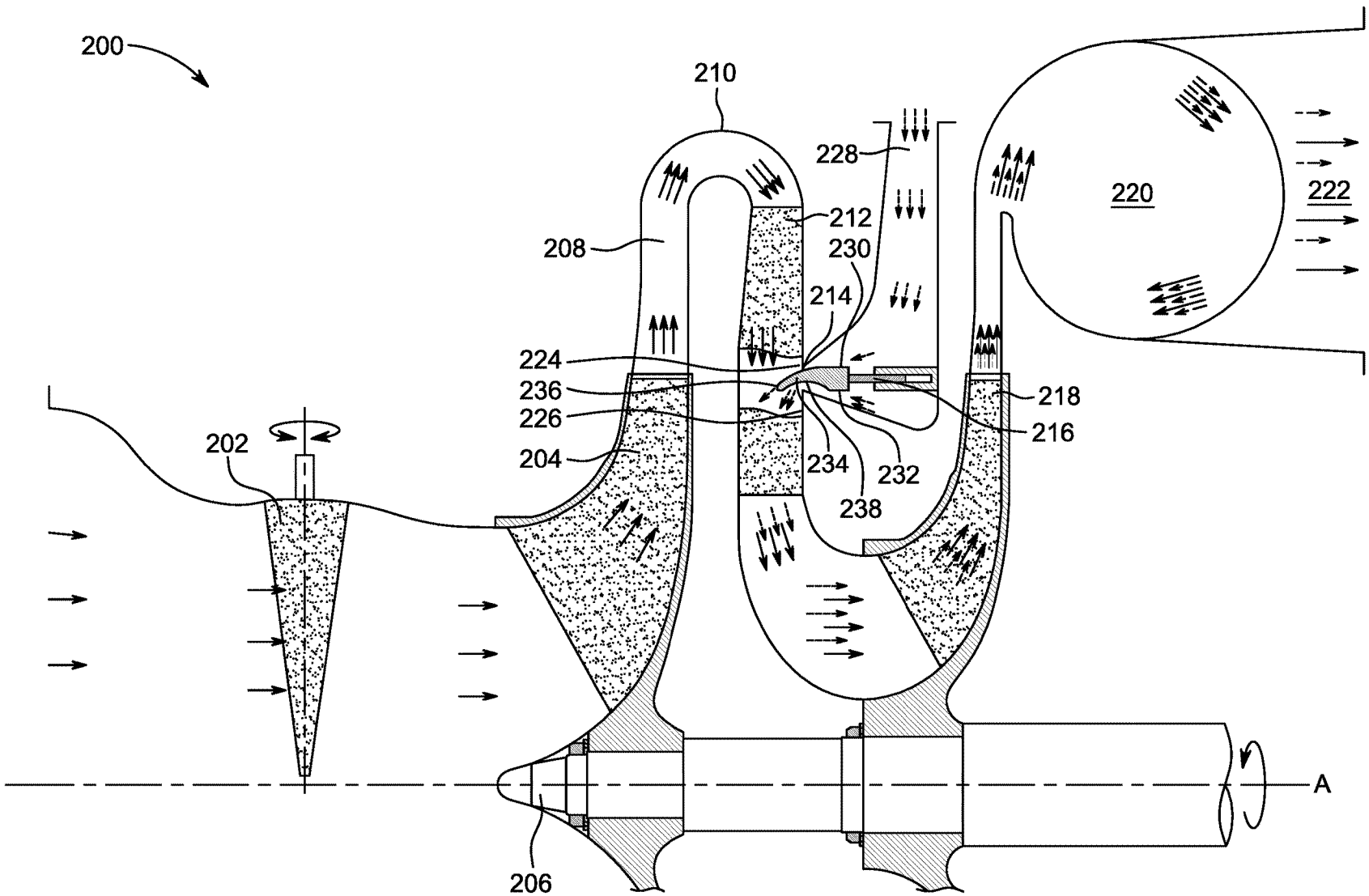
FIG. 2C shows a sectional view of the compressor shown in FIG. 2A when the capacity control valve is in a low flow position.

FIG. 2C shows a sectional view of the compressor shown in FIG. 2A when the capacity control valve 216 is in a low flow position. The low flow position shown in FIG. 2C can be used in a partial load condition where the load is below the full load for the compressor 200, and less than the load where the capacity control valve is in a high flow position such as in FIG. 2B. In the low flow position shown in FIG. 2C, capacity control valve 216 is extended further into the interstage flow from return bend 210 to second impeller 218. The capacity control valve 216 thus provides even greater resistance to the interstage flow when compared to the high flow position shown in FIG. 2B. In the low flow position of the embodiment shown in FIG. 2C, a first gap exists between the leading end 224 of the side stream injection port and the leading side 230 of the capacity control valve 216, and a second gap exists at passage 238 between the trailing side 232 of the capacity control valve 216 and the trailing end 226 of the side stream injection port 214. Compared to the first and second gaps shown of the high flow position shown in FIG. 2B, in the low flow position of FIG. 2C, the second gap is relatively larger compared to the first, and a greater proportion of the side stream flow passes through the second gap to join the interstage flow relative to the amount of the side stream flow passing through the first gap. Optionally, in the low flow position shown in FIG. 2C, inlet guide vane 202 can be in a low flow position where the inlet guide vane 202 provides increased resistance to flow into the first stage impeller 204 compared to the high flow position shown in FIG. 2B, but less resistance to flow than the closed positions shown in FIG. 2D. In the low-flow position shown in FIG. 2B, flow through side stream injection port 214 can primarily or entirely be past the trailing side 232 of the capacity control valve. The shape of the leading side 230 and of passage 238 can each or both be selected to control the relative amount of flow being introduced on either the leading side 230 or trailing side 232 of the capacity control valve 216, and how those relative amounts vary with the position of capacity control valve 216 from the fully open position through the closed position as shown in FIGS. 2A-2D.

In an embodiment, side stream flow channel 228 can receive the side stream flow from an economizer, such as economizer 314 shown in FIG. 3B and described below. Providing passage 238 in capacity control valve 216 can allow capacity control valve 216 to not only control the quantity of flow being introduced, but the particular point at which the side stream is introduced in side stream injection port 214, and the pressure at the point of introduction. Controlling the position of the point of introduction of side stream flow can provide control over the relationship between core flow and side stream flow in the compressor. Control of the point of introduction can improve economizer effectiveness across different load conditions. The low flow position shown in FIG. 2C can be used when compressor 200 is operated at part load. When the compressor 200 is operated at part load, the static pressure at the side stream injection port 214, particularly between leading end 222 of the side stream injection port 214 and the leading side 232 of the capacity control valve 216, can be relatively elevated. The pressure within the economizer is a function of the static pressure at the injection location in compressor 200, in addition to pipe losses and fixed orifice pressure drops for the system. The elevated pressure at side stream injection port 214 can therefore lead to an elevated pressure at the economizer, reducing effectiveness in removing flash or bypass gas from the fluid contained within. Passage 238, by being on an opposite side of the capacity control valve 216 from leading side 232 that is facing the interstage flow within compressor 200, is subject to a reduced pressure in comparison to the pressure on the leading side 232, or the static pressure at the side stream injection port 114 in the embodiment shown in FIG. 1C. The reduced pressure at such an injection point can correspondingly lower the pressure within the economizer as described above, improving the release of flash or bypass gas from liquid in the economizer and its removal from the stream of working fluid passing to the evaporator. This improves the heat transfer at the evaporator and can also reduce recompression losses in the system including compressor 200 having capacity control valve 216 including passages 238.

Figure 2D:
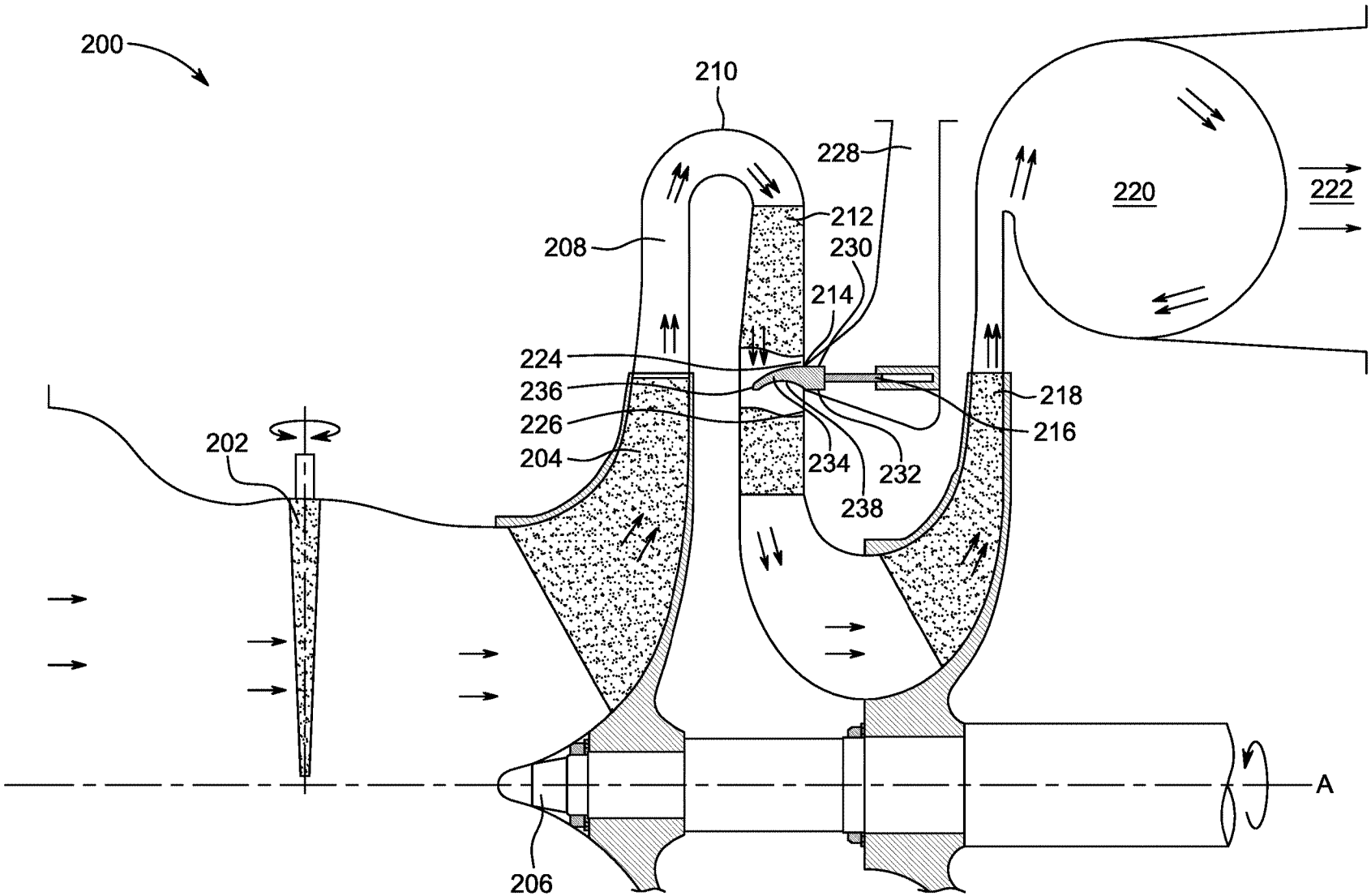
FIG. 2D shows a sectional view of the compressor shown in FIG. 2A when the capacity control valve is in a closed position.

FIG. 2D shows a sectional view of the compressor shown in FIG. 2A when the capacity control valve 216 is in a closed position. The closed position shown in FIG. 2D can be used when the compressor 200 is in a partial-load condition at or near a minimum load for the compressor. In the closed position, capacity control valve 216 partially or completely obstructs side stream injection port 214, from leading end 224 to trailing end 226. It is appreciated that due to manufacturing tolerances, etc., there may be some possible leakage even when capacity control valve 216 is in the closed position. In an embodiment, capacity control valve 216 may be sized such that it does not contact side stream injection port 214, and allows some flow through the gap between the side stream injection port 214 and the capacity control valve 216. Any features of capacity control valve 216 configured to allow the introduction of the side stream flow on the trailing side 232 of the capacity control valve 216 such as passage 238 can be configured such that they do not permit such flow when capacity control valve 216 in the closed position. For example, as shown in FIG. 2D, a scalloped portion on the trailing side 232 forming passage 238 in this embodiment is sized and positioned such the trailing side 232 contacts the trailing end 226 of side stream injection port 214 when the capacity control valve 216 is extended into the closed position. The extension of the capacity control valve 216 into the interstage flow through compressor 200 is at a maximum, reducing the size of the orifice through which the interstage flow passes from return bend 210 towards second stage impeller 218. Accordingly, this position imparts the greatest additional velocity to the interstage flow, while prohibiting the side stream flow from joining the interstage flow. Optionally, inlet guide vane 202 can be rotated to further obstruct flow to the first stage impeller 204 of compressor 200, for example by pacing the inlet guide vane 202 in a minimum-flow position.

Figure 3A:
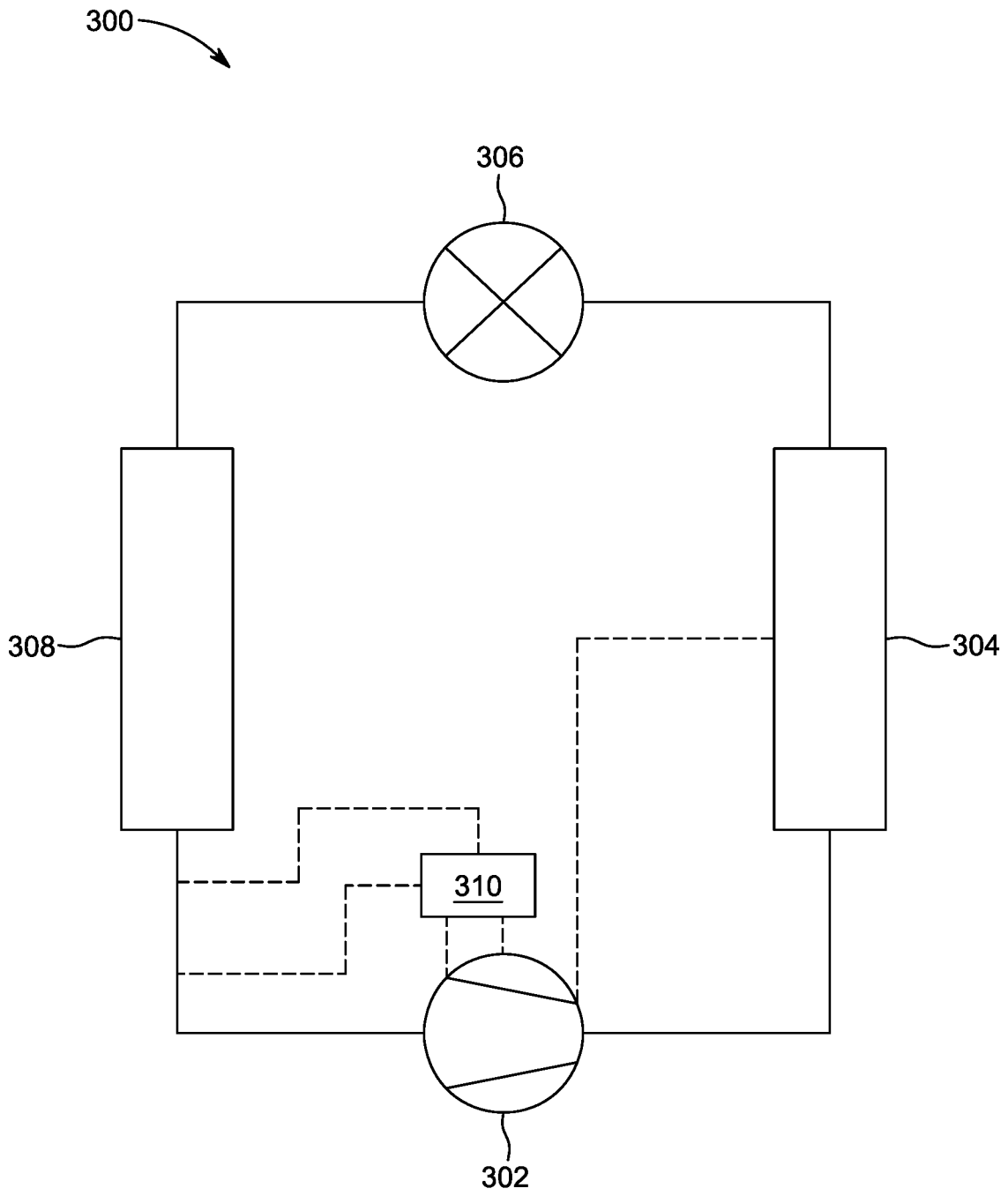
FIG. 3A shows a heating, ventilation, air conditioning and refrigeration (HVACR) circuit according to an embodiment.

FIG. 3A shows a heating, ventilation, air conditioning and refrigeration (HVACR) circuit according to an embodiment. HVACR circuit 300 includes compressor 302, condenser 304, expander 306, and evaporator 308.

Compressor 302 is a centrifugal compressor, for example compressor 100 shown in FIGS. 1A-1D or compressor 200 shown in FIGS. 2A-2D and described above.

Condenser 304 receives working fluid from compressor 302 and allows the working fluid to reject heat, for example to air or another heat exchange medium. In an embodiment, a fluid line from the condenser 304 can convey some of the working fluid of HVACR circuit 300 back to compressor 302, as the side stream flow provided to the side stream flow injection port of the compressor 302, such as side stream injection ports 114 or 214 described above and shown in FIGS. 1A-2D. Condensed working fluid from condenser 304 can then pass to expander 306.

Expander 306 expands the working fluid passing through as the fluid passes through HVACR circuit 300. Expander 306 can be any suitable expander for the working fluid within the HVACR circuit 300, such as, for example, an expansion valve, one or more expansion orifices, or any other suitable expansion device for use in an HVACR circuit.

Evaporator 308 is a heat exchanger where the working fluid of HVACR circuit 300 absorbs heat, for example from an ambient environment or a fluid to be cooled such as water in a water chiller HVACR system. The evaporator 308 can be, for example, an indoor coil of an air conditioner or a heat exchanger configured to cool water used in an HVACR system including the HVACR circuit 300.

HVACR circuit 300 can further include an intercooler 310. Intercooler 310 is a heat exchanger where working fluid from the HVACR circuit exchanges heat with the interstage flow within compressor 302. The working fluid that exchanges heat with the interstage flow in intercooler 310 can be sourced from, for example, evaporator 308, between expander 306 and evaporator 308, or between the evaporator 308 and the compressor 302. Some or all of the working fluid that exchanges heat with the interstage flow can then be reintroduced into HVACR circuit 300 downstream of where the working fluid is sourced. In an embodiment, at least some of the working fluid from intercooler 310 can be directed to a side stream flow channel of compressor 302 instead of returning to the ordinary flow path through HVACR circuit 300. The side stream flow channel can be, for example, side stream flow channel 128 or side stream flow channel 228 of the compressors 100 and 200 described above and shown in FIGS. 1A-1D and 2A-2D.

Figure 3B:
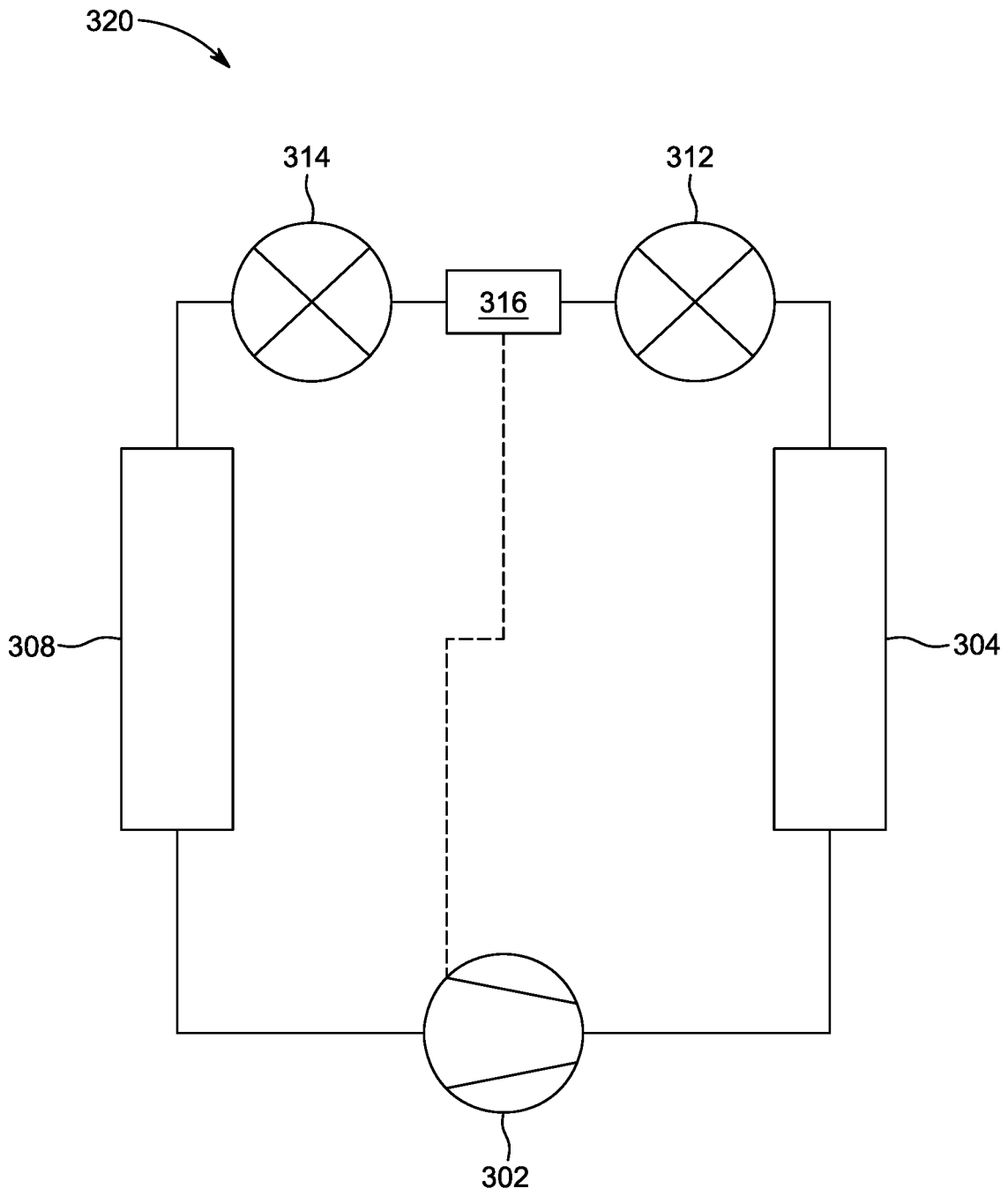
FIG. 3B shows an economized HVACR circuit 320 according to an embodiment.

FIG. 3B shows an economized HVACR circuit 320 according to an embodiment. In FIG. 3B, compressor 302, condenser 304 and evaporator 308 are included as in HVACR circuit 300 described above and shown in FIG. 3A, with compressor 302 being a multi-stage compressor in this embodiment. HVACR circuit 320 includes a first expander 312 and a second expander 314. Each of first expander 312 and second expander 314 can be any suitable expander for the working fluid within the HVACR circuit 320 such as, for example, an expansion valve, one or more expansion orifices, or any other suitable expansion device for use in an HVACR circuit. Economizer 314 can be disposed between first and second expanders 312, 314, such that working fluid of HVACR circuit 320 is at an intermediate pressure at the economizer 314. The economizer 314 can be used as a source for the side stream introduced into compressor 302, for example through a side stream flow channel such as side stream flow channel 128 or side stream flow channel 228 as described above and shown in FIGS. 1A-1D and 2A-2D.

Figure 4:
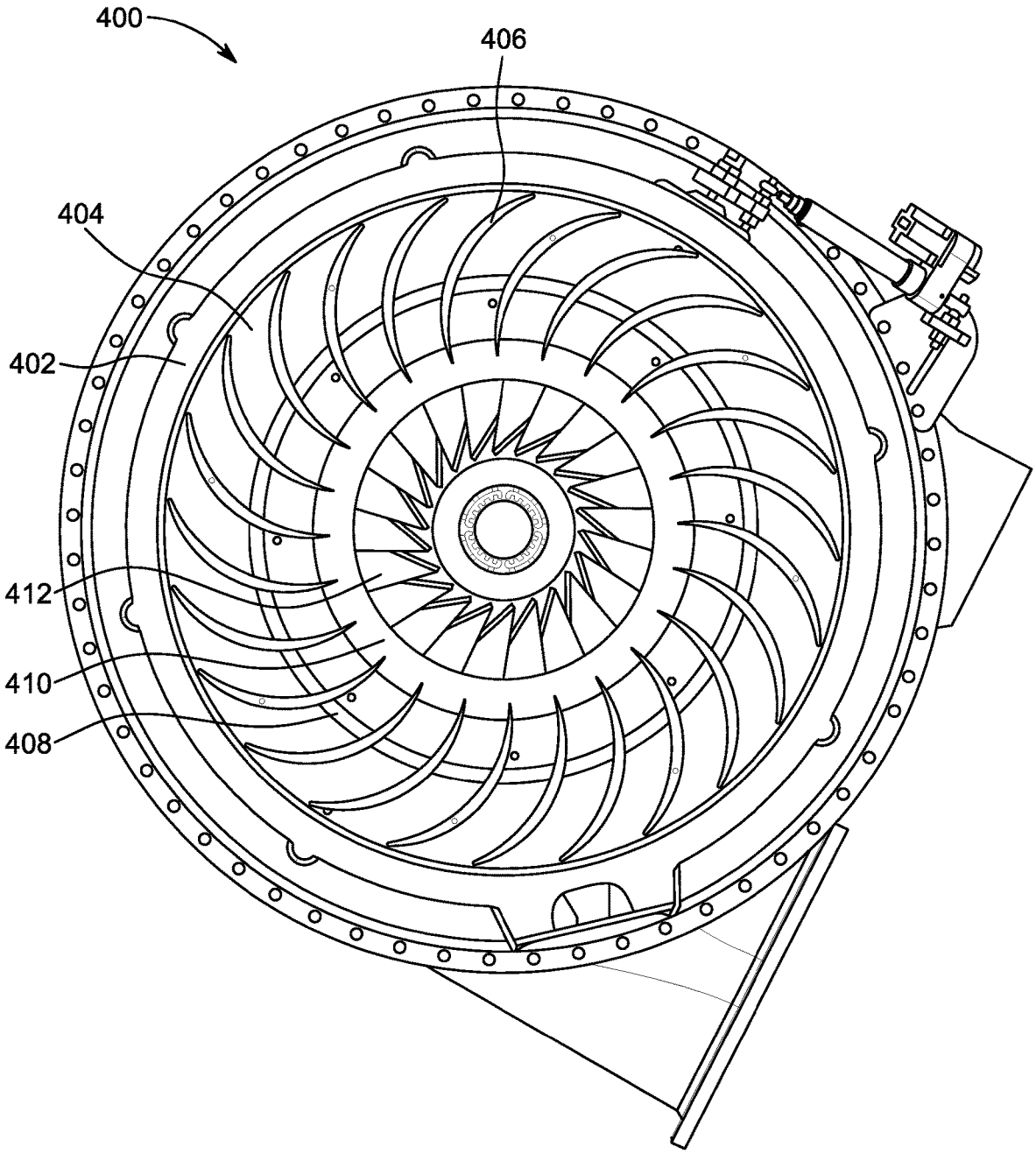
FIG. 4 shows a sectional view of a centrifugal compressor according to an embodiment along an interstage flow path.

FIG. 4 shows a sectional view of a centrifugal compressor according to an embodiment along an interstage flow path. Centrifugal compressor 400 includes compressor housing 402. Compressor housing 402 in part defines an interstage flow path 404. The interstage flow path includes deswirl vanes 406 radially distributed around the interstage flow path 404. Capacity control valve ring 408 extends into interstage flow path 404, upstream of following stage inlet 410. Capacity control valve ring can 408 be, for example, capacity control valve 116 or capacity control valve 216 as described above and shown in FIGS. 1A-1D and 2A-2D. Capacity control valve ring 408 can be a single continuous ring or composed of a plurality of ring segments that combine to provide the ring shape. Following stage inlet 410 receives flow passing the capacity control valve ring 408 and allows the flow to enter into the following stage impeller 412.

Figure 5:
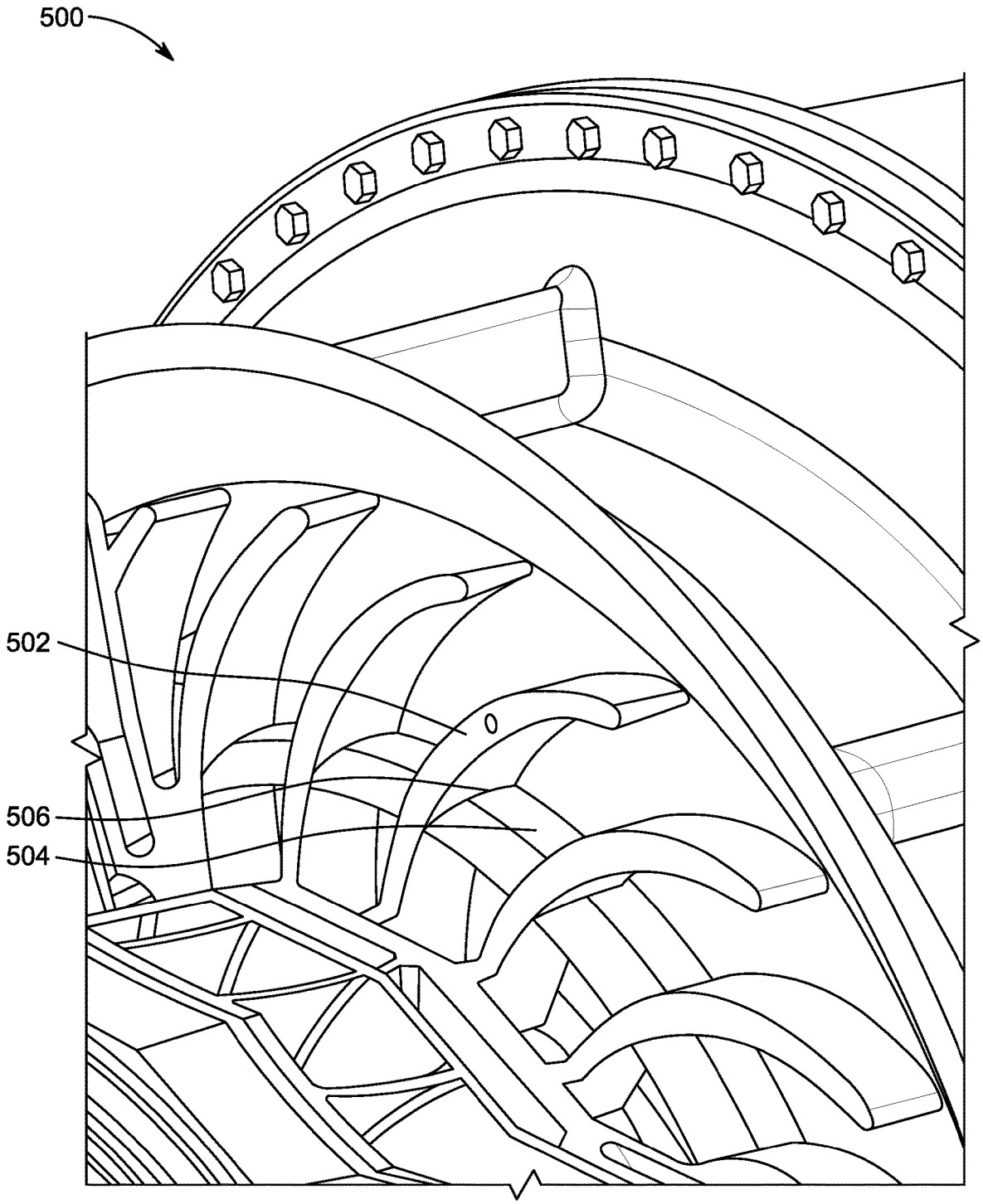
FIG. 5 shows a sectional view of a portion of a centrifugal compressor according to an embodiment.

FIG. 5 shows a sectional view of a portion of a centrifugal compressor according to an embodiment. In the view of centrifugal compressor 500, the interaction between the deswirl vanes 502 and the capacity control valve ring 504. Deswirl vanes 502 can be any of the deswirl vanes shown in FIG. 1A-1D, 2A-2D, or 4. Capacity control valve ring 504 can be any of the capacity control valves shown in FIG. 1A-1D, 2A-2D, or 4. Capacity control valve ring includes notches 506, each of notches 506 configured to accommodate one of the deswirl vanes 502 such that the capacity control valve ring 504 can be extended into a flow path including the deswirl vanes 502 without mechanically interfering with the deswirl vanes 502. In an embodiment, notches corresponding to notches 506 can instead be included on each of the deswirl vanes 502 such that the deswirl vanes 502 do not contact the capacity control valve ring 504 as it is extended. In an embodiment, notches 506 are provided along with corresponding notches on the deswirl vanes 502. In this embodiment, the notches 506 can have a depth that is less than an entire height of the area where capacity control valve ring 504 could contact deswirl vanes 502, and the notches in the deswirl vanes have a depth such that they accommodate any portion of capacity control valve ring 504 that would otherwise contact the deswirl vanes 502 in the absence of said notches.

ASPECTS

It is understood that any of aspects 1-12 can be combined with any of aspects 13-19.

Aspect 1. A centrifugal compressor, comprising:

a first stage impeller;

a second stage impeller;

a side stream injection port located between the first stage impeller and the second stage impeller, the side stream injection port configured to receive a side stream of a fluid; and a capacity control valve, the capacity control valve configured to extend and retract through the side stream injection port, wherein:

the capacity control valve has a curved surface facing a direction of flow from the first stage impeller to the second stage impeller; and the capacity control valve is configured to be extended through the side stream injection port between an open position where the side stream of the fluid can flow through the side stream injection port and a closed position where the capacity control valve obstructs flow of the side stream of the fluid through the side stream injection port.

Aspect 2. The centrifugal compressor according to aspect 1, wherein the capacity control valve has a ring shape.

Aspect 3. The centrifugal compressor according to any of aspects 1-2, comprising a plurality of the side stream injection ports and a plurality of the capacity control valves.

Aspect 4. The centrifugal compressor according to any of aspects 1-3, wherein in the open position, a tip of the capacity control valve at an end of the curved surface is within the side stream injection port.

Aspect 5. The centrifugal compressor according to any of aspects 1-4, wherein the capacity control valve extends and retracts in a direction substantially perpendicular to the direction of flow from the first stage impeller to the second stage impeller.

Aspect 6. The centrifugal compressor according to any of aspects 1-5, further comprising one or more deswirl vanes between the first stage impeller and the second stage impeller.

Aspect 7. The centrifugal compressor according to aspect 6, wherein the capacity control valve includes one or more notches, the one or more notches each configured to accommodate at least a portion of one of the one or more deswirl vanes.

Aspect 8. The centrifugal compressor according to any of aspects 6-7, wherein the one or more deswirl vanes each include one or more notches, the one or more notches each configured to accommodate at least a portion of the capacity control valve.

Aspect 9. The centrifugal compressor of any of aspects 1-8, wherein the capacity control valve has a linear meridional profile on a side opposite the curved surface, the linear meridional profile contacting an edge of the side stream injection port.

Aspect 10. The centrifugal compressor of any of aspects 1-9, wherein a side of the capacity control valve opposite the curved surface is configured such that when the capacity control valve is between the open position and the closed position, the fluid can flow past the capacity control valve on the side of the capacity control valve opposite the curved surface.

Aspect 11. The centrifugal compressor according to aspect 10, wherein the side of the capacity control valve opposite the curved surface includes a second curved surface.

Aspect 12. The centrifugal compressor according to any of aspects 10-11, wherein the side of the capacity control valve opposite the curved surface includes one or more channels configured to allow flow of the side stream of the fluid.

Aspect 13. A heating, ventilation, air conditioning, and refrigeration (HVACR) circuit, comprising:

a centrifugal compressor;

a condenser;

an expander; and an evaporator, wherein the centrifugal compressor includes:

a first stage impeller;

a second stage impeller;

a side stream injection port located between the first stage impeller and the second stage impeller, the side stream injection port configured to receive a side stream of a fluid; and a capacity control valve, the capacity control valve configured to extend and retract through the side stream injection port, the capacity control valve has a curved surface facing a direction of flow from the first stage impeller to the second stage impeller; and the capacity control valve is configured to be extended through the side stream injection port between an open position where the side stream of the fluid can flow through the side stream injection port and a closed position where the capacity control valve obstructs flow of the side stream of the fluid through the side stream injection port.

Aspect 14. The HVACR circuit according to aspect 13, wherein the side stream of the fluid is from the condenser to the side stream injection port.

Aspect 15. The HVACR circuit according to aspect 13, further comprising an economizer and wherein the side stream of the fluid is from the economizer to the side stream injection port.

Aspect 16. The HVACR circuit according to aspect 13, further comprising an intercooler and wherein the side stream of the fluid is from the intercooler to the side stream injection port.

Aspect 17. The HVACR circuit according to any of aspects 13-16, wherein the capacity control valve has a ring shape.

Aspect 18. The HVACR circuit according to any of aspects 13-17, wherein the capacity control valve has a linear meridional profile on a side opposite the curved surface, the linear meridional surface contacting an edge of the side stream injection port.

Aspect 19. The HVACR circuit according to any of aspects 13-17, wherein a side of the capacity control valve opposite the curved surface is configured such that when the capacity control valve is between the open position and the closed position, the fluid can flow past the capacity control valve on the side of the capacity control valve opposite the curved surface.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A centrifugal compressor, comprising:

a first stage impeller;

a second stage impeller;

a side stream injection port located between the first stage impeller and the second stage impeller, the side stream injection port configured to receive a side stream of a fluid; and a capacity control valve, the capacity control valve configured to extend and retract through the side stream injection port, wherein:

the capacity control valve has a curved surface facing a direction of flow from the first stage impeller to the second stage impeller;

the capacity control valve is configured to be extended into a flow from the first stage impeller to the second stage impeller; and the capacity control valve is configured to be extended through the side stream injection port between an open position where the side stream of the fluid can flow through the side stream injection port and a closed position where the capacity control valve obstructs flow of the side stream of the fluid through the side stream injection port.

2. The centrifugal compressor of claim 1, wherein the capacity control valve has a ring shape.

3. The centrifugal compressor of claim 1, comprising a plurality of the side stream injection ports and a plurality of the capacity control valves.

4. The centrifugal compressor of claim 1, wherein in the open position, a tip of the capacity control valve at an end of the curved surface is within the side stream injection port.

5. The centrifugal compressor of claim 1, wherein the capacity control valve extends and retracts in a direction perpendicular to the direction of flow from the first stage impeller to the second stage impeller.

6. The centrifugal compressor of claim 1, further comprising one or more deswirl vanes between the first stage impeller and the second stage impeller.

7. The centrifugal compressor of claim 6, wherein the capacity control valve includes one or more notches, the one or more notches each configured to accommodate at least a portion of one of the one or more deswirl vanes.

8. The centrifugal compressor of claim 6, wherein the one or more deswirl vanes each include one or more notches, the one or more notches each configured to accommodate at least a portion of the capacity control valve.

9. The centrifugal compressor of claim 1, wherein the capacity control valve has a linear meridional profile on a side opposite the curved surface, the linear meridional profile contacting an edge of the side stream injection port.

10. The centrifugal compressor of claim 1, wherein a side of the capacity control valve opposite the curved surface is configured such that when the capacity control valve is between the open position and the closed position, the fluid can flow past the capacity control valve on the side of the capacity control valve opposite the curved surface.

11. The centrifugal compressor of claim 10, wherein the side of the capacity control valve opposite the curved surface includes a second curved surface.

12. The centrifugal compressor of claim 10, wherein the side of the capacity control valve opposite the curved surface includes one or more channels configured to allow flow of the side stream of the fluid.

13. A heating, ventilation, air conditioning, and refrigeration (HVACR) circuit, comprising:

a centrifugal compressor;

a condenser;

an expander; and an evaporator, wherein the centrifugal compressor includes:

a first stage impeller;

a second stage impeller;

a side stream injection port located between the first stage impeller and the second stage impeller, the side stream injection port configured to receive a side stream of a fluid; and a capacity control valve, the capacity control valve configured to extend and retract through the side stream injection port, the capacity control valve has a curved surface facing a direction of flow from the first stage impeller to the second stage impeller;

the capacity control valve is configured to be extended into a flow from the first stage impeller to the second stage impeller; and the capacity control valve is configured to be extended through the side stream injection port between an open position where the side stream of the fluid can flow through the side stream injection port and a closed position where the capacity control valve obstructs flow of the side stream of the fluid through the side stream injection port.

14. The HVACR circuit of claim 13, wherein the side stream of the fluid is from the condenser to the side stream injection port.

15. The HVACR circuit of claim 13, further comprising an economizer and wherein the side stream of the fluid is from the economizer to the side stream injection port.

16. The HVACR circuit of claim 13, further comprising an intercooler and wherein the side stream of the fluid is from the intercooler to the side stream injection port.

17. The HVACR circuit of claim 13, wherein the capacity control valve has a ring shape.

18. The HVACR circuit of claim 13, wherein the capacity control valve has a linear meridional profile on a side opposite the curved surface, the linear meridional profile contacting an edge of the side stream injection port.

19. The HVACR circuit of claim 13, wherein a side of the capacity control valve opposite the curved surface is configured such that when the capacity control valve is between the open position and the closed position, the fluid can flow past the capacity control valve on the side of the capacity control valve opposite the curved surface.

* * * * *